US012092434B1

(12) United States Patent
Sadler

(10) Patent No.: US 12,092,434 B1
(45) Date of Patent: Sep. 17, 2024

(54) ASYMMETRIC EXPLOSIVE REACTIVE ARMOR (ERA)

(71) Applicant: Raytheon Company, Tewksbury, MA (US)

(72) Inventor: Coulton T. Sadler, Tucson, AZ (US)

(73) Assignee: Raytheon Company, Tewksbury, MA (US)

( * ) Notice: Subject to any disclaimer, the term of this patent is extended or adjusted under 35 U.S.C. 154(b) by 19 days.

(21) Appl. No.: 18/133,781

(22) Filed: Apr. 12, 2023

(51) Int. Cl.
*F41H 5/007* (2006.01)
*F41H 5/02* (2006.01)

(52) U.S. Cl.
CPC ..... *F41H 5/007* (2013.01); *F41H 5/023* (2013.01)

(58) Field of Classification Search
CPC ..... F41H 5/007; F41H 5/023
See application file for complete search history.

(56) References Cited

U.S. PATENT DOCUMENTS 3,893,368 A 7/1975 Wales, Jr.
4,867,077 A 9/1989 Marlow et al.
4,981,067 A 1/1991 Kingery
5,370,034 A 12/1994 Turner et al.
5,413,027 A * 5/1995 Mixon ..... F41H 5/007 89/36.17
5,577,432 A 11/1996 Becker et al.
6,662,726 B1 * 12/2003 Steiner ..... F42B 12/06 102/521
10,670,375 B1 * 6/2020 Cannon ..... F41H 5/026
2012/0204711 A1 * 8/2012 Engleman ..... F41H 5/013 89/937
2013/0000475 A1 * 1/2013 Eckhoff ..... F42D 5/045 156/60
2013/0087038 A1 * 4/2013 Diehl ..... F41H 5/007 89/902

(Continued)

OTHER PUBLICATIONS

Gurney, Ronald W, "The Initial Velocities of Fragments from Bombs, Shells, and Grenades", Ballistic Research Laboratory, Aberdeen, Maryland, BRL-405, 1943, 22 pgs.

(Continued)

*Primary Examiner* — Joshua E Freeman
(74) *Attorney, Agent, or Firm* — Schwegman Lundberg & Woessner, P.A.

(57) ABSTRACT

An asymmetric ERA box improves the disruption of a shape-charge jet for a high-explosive projectile for a given mass requirement and stand-off distance. Mass is asymmetrically redistributed from the outer plate to the rear plate in the form of increased thickness of the rear plate. This is offset by forming the outer plate of a low-density material that provides an impedance mismatch sufficient to attenuate the shockwave of low velocity projectiles (e.g., 50 caliber bullets) so that they embed in but do not detonate the explosive. The outer plate provides negligible disruption of the shape-charge jet with substantially all the disruption being provided by the thicker high density rear plate. Placement of substantially all the mass toward the front of the shape-charge jet improves overall performance of the ERA. This asymmetric configuration provides the same performance as known symmetric ERA configurations against kinetic-energy projectiles as the total mass in the outer and rear plates remains essentially the same.

20 Claims, 10 Drawing Sheets

(56) References Cited

U.S. PATENT DOCUMENTS

| | | | | |
|---|---|---|---|---|
| 2015/0226528 | A1* | 8/2015 | Bottiglieri | F41H 5/007 89/36.02 |
| 2016/0169633 | A1* | 6/2016 | Xu | B32B 27/12 89/36.02 |
| 2018/0299229 | A1* | 10/2018 | Cohen | F41H 7/04 |

OTHER PUBLICATIONS

Held, Manfred, "Dynamic Plate Thickness of ERA Sandwiches against Shaped Charge Jets", Propellants, Explosives, Pyrotechnics 29 (2004), No. 4, 244-246.

* cited by examiner

ASYMMETRIC EXPLOSIVE REACTIVE ARMOR (ERA)

BACKGROUND

Field

This disclosure relates to explosive reactive armor (ERA) for military vehicles such as tanks and armored personnel carriers or stationary targets such as bunkers and for protecting the surface area of the vehicle or target from attack and penetration of its residual or basal armor by various types of projectiles and specifically those projectiles that produce a shape-charge jet to penetrate the armor.

Description of the Related Art

As described in U.S. Pat. No. 6,662,726 entitled "Kinetic Energy Penetrator" issued Dec. 16, 2003 there exists an ongoing evolution of both the armor used on armored vehicles (e.g., tanks and armored personnel carriers (APC's)) and the projectiles used to defeat such armor.

Common anti-armor projectiles of the type fired by tank guns and artillery are typically divided into high explosive and kinetic energy subgroups. High explosive anti-tank (HEAT) projectiles typically include one or more shaped explosive charges which, upon detonation in close proximity to the armor, cause a concentrated jet to penetrate the armor. Common kinetic energy projectiles make use of a long rod penetrator to punch a hole through the armor. As implied by its name, the long rod penetrator includes an elongate, dense, heavy penetrator body or core having a relatively small cross-section. Upon impact with the armor, this small cross-section provides a concentration of impact force on the armor effective to penetrate the armor. Long rod penetrators are typically utilized in armor-piercing fin-stabilized discarding sabot (APFSDS) ammunition.

To defeat modern anti-tank projectiles, explosive reactive armor (ERA), also known as reactive armor (RA) and reactive explosive armor (REA), has been developed. Various ERA forms are disclosed in U.S. Pat. Nos. 4,867,077, 5,577,432, 5,413,027, 5,370,034, and 4,981,067, the disclosures of which are incorporated herein by reference in their entireties. Most ERA is modular, with individual modules formed as "boxes" which are typically rectangular prisms but may be otherwise formed. Each ERA box typically includes: an outer layer or plate ("outer plate") of steel, facing generally outward from the vehicle; a layer of explosive inboard thereof; and an additional layer or plate ("rear plate") of steel inboard of the explosive. The ERA boxes are arrayed over the surface of the vehicle to be protected and may be directly in contact with the basal armor of the vehicle or may be held slightly spaced-apart from the basal armor.

When a rod penetrator impacts ERA, contact between the penetrator and the outer plate produces a shockwave which detonates the explosive layer. The explosion drives the outer plate further outward. Where the outer surface of the outer plate is not normal to the impact trajectory of the projectile, contact between the outer plate and the projectile produces a deflecting force on the projectile, deflecting both its orientation (defined by its longitudinal axis) and its subsequent trajectory (defined by the path of its center of mass) away from normal to the basal armor. Initially, the impact may bend the penetrator proximate its fore end. The penetrator will typically penetrate the outer plate producing a hole therein. Such penetration does not end the interaction between the outer plate and the projectile. A side of the penetrator will remain in contact with a side of the hole in the outer plate as the penetrator continues inward toward the vehicle and the plate continues outward. The result is a continued deflective force on the penetrator normal to its impact trajectory.

If applicable, a rear plate of the ERA may be driven backward (toward the basal armor) by the explosion. This further enhances deflection since the movement of the rear plate will have a component normal to the impact trajectory. Thus, upon penetration of the outer plate and engagement with the rear plate, this relative movement will continuously expose new material on the rear plate to the already deflected penetrator fore end. This further deflects the projectile and provides a potentially greater dissipation of projectile kinetic energy than if the rear plate were simply affixed flat against the basal armor. When the penetrator finally reaches the basal armor, its trajectory has been deflected further off normal to the basal armor and its tip bent yet further off normal so that the projectile is more likely to deflect off the basal armor or attack such a large area of the basal armor that the penetrator will not cause significant penetration of the basal armor.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides an ERA box designed to be held at a stand-off distance from a residual armor surface that improves the disruption of a shape-charge jet for a high-explosive projectile for a given mass requirement. This is accomplished by asymmetrically redistributing mass to the rear plate in the form of increased thickness. This is offset by forming the outer plate of a low-density material that provides an impedance mismatch sufficient to attenuate the shockwave of low velocity projectiles (e.g., 50 caliber bullets) so that they embed in but do not detonate the explosive. The impedance mismatch outer plate provides negligible disruption of a high velocity shape-charge jet with substantially all the disruption being provided by the thicker high density rear plate. Placement of substantially all the mass toward the front of the shape-charge jet improves overall performance of the ERA. This asymmetric configuration provides the same performance as known symmetric ERA configurations against kinetic-energy projectiles as the total mass in the outer and rear plates remains essentially the same.

In an embodiment, asymmetric ERA comprises an explosive layer sandwiched between an impedance mismatch outer plate and a rear plate. The impedance mismatch outer plate is formed of material having a density $\rho_o$ of less than 2 g/cm$^3$ and the rear plate is formed from a material having a density $\rho_r$ of at least 4.5 g/cm$^3$. The impedance mismatch outer plate and rear plate provide less than 10% and greater than 60%, respectively, of the areal density of the asymmetric ERA.

The outer plate material has an impedance Z given by density $\rho_o$*shock velocity U where U=bulk sound speed Co+(particle velocity u*slope s) where particle velocity u is the impact velocity of a projectile. $\rho_o$ is less than 2 g/cm$^3$ and preferably less than 1 gm/cm$^3$. Co is less than 3 km/s and more preferably <2.5 km/s. The outer plate is typically between 0.5 and 2 cm thick. Materials such as high-density polyethylene (HDPE), rubber, epoxy or wax provide impedance Z values that serve to slow, and thus attenuate the shockwaves for low-velocity projectiles. As a result, initial shockwaves that exceed the detonation threshold of the explosive are rapidly attenuated to avoid detonation. High-velocity shape charge jets pass through the outer plate and detonate the explosive layer.

The rear plate material exhibits both high density, $\rho_r$ of at least 4.5 g/cm$^3$ and preferably greater than 7 g/cm$^3$, and high yield strength $\sigma_r$ greater than 500 Mega Pascals (MPA) and preferably greater than 1,000 MPAs that is efficient at breaking up the shape charge jet. The rear plate is typically thicker than the outer plate, and most importantly is significantly thicker than the rear plate in a conventional symmetric ERA thereby placing more high-density material toward the front of the shape charge jet. Materials such as steel, iron, tungsten and titanium are high density, high yield strength materials.

The stand-off distance of the asymmetric ERA box from the residual armor is typically 30-50% of the total ERA height above the residual armor. The stand-off distance is also between 135 and 285% of the thickness of the rear plate.

A ratio of the areal density of the rear plate to the area density of the outer plate is at least 6:1. This represents a significant redistribution of mass from the outer plate to the rear plate. In a symmetric ERA box this ratio would be 1:1. An areal density budget for an asymmetric ERA box is a front wall of the casing 2.5-5%; the impedance mismatch outer layer 5-10%; the explosive layer 10-25%; the rear plate 60-75%; and the back wall of the casing 2.5-5%. By comparison, if the two plates consume 80% of the areal density budget, in a symmetric ERA box the outer and rear plates would each be 40%.

These and other features and advantages of the disclosure will be apparent to those skilled in the art from the following detailed description of preferred embodiments, taken together with the accompanying drawings, in which:

DETAILED DESCRIPTION

An asymmetric ERA box improves the disruption of a shape-charge jet for a high-explosive projectile for a given mass requirement and stand-off distance. Mass is asymmetrically redistributed from the outer plate to the rear plate in the form of increased thickness of the rear plate. This is offset by forming the outer plate of a low-density material that provides an impedance mismatch sufficient to attenuate the shockwave of low velocity projectiles (e.g., 50 caliber bullets) so that they embed in but do not detonate the explosive. The outer plate provides negligible disruption of the shape-charge jet with substantially all the disruption being provided by the thicker high density rear plate. Placement of substantially all the mass toward the front of the shape-charge jet improves overall performance of the ERA. This asymmetric configuration provides the same performance as known symmetric ERA configurations against kinetic-energy projectiles as the total mass in the outer and rear plates remains essentially the same.

Figure 1:
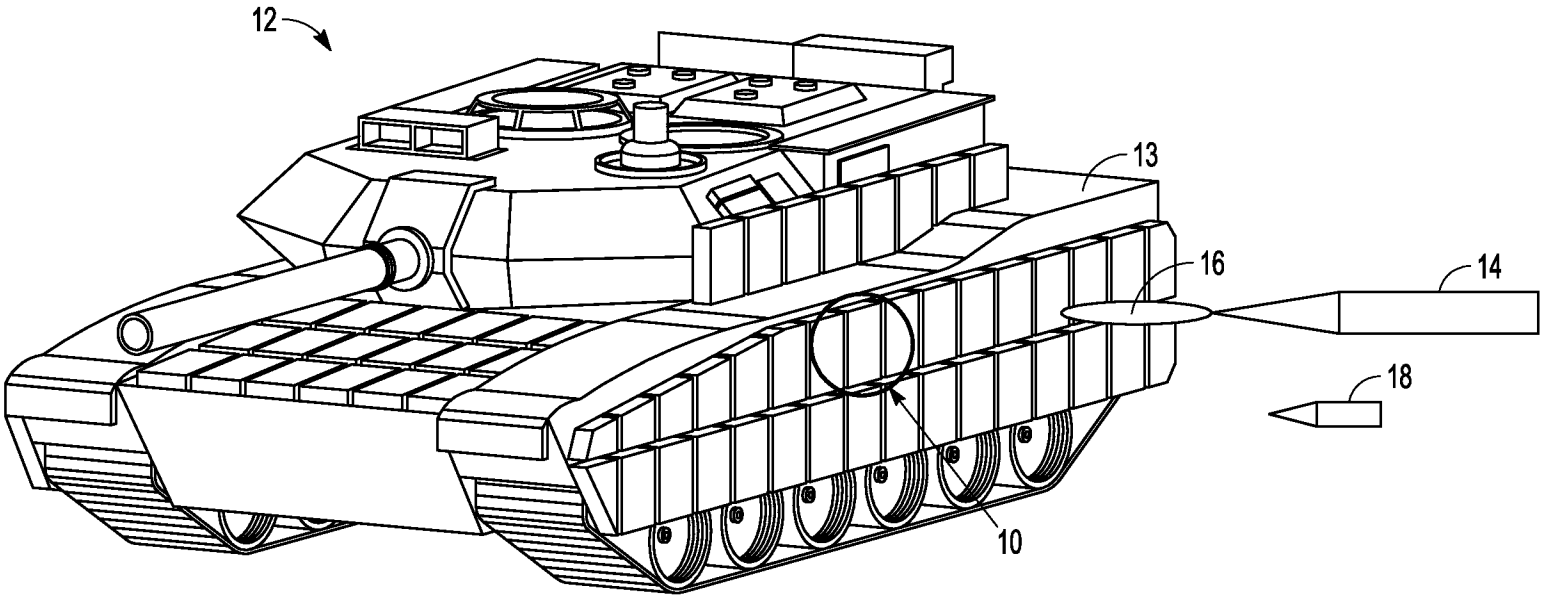
FIG. 1 is an illustration of a tank outfitted with ERA.

Referring now to FIG. 1, modular asymmetric ERA boxes 10 are positioned about a tank 12 to protect the most vulnerable areas of the tank's residual armor 13 including the front of the tank, turret and tracks from attack from anti-armor projectiles such as high explosive and kinetic energy projectiles. High explosive anti-tank (HEAT) projectiles 14 such as rocket propelled grenades (RPGS) typically include one or more shaped explosive charges which, upon detonation in close proximity to the tank's armor, cause a concentrated jet 16 to attempt to penetrate the armor residual. The tail of jet 16 is the slowest at about 2 km/s and tip of the jet is the fastest at about 9-10 km/s. For the same weight and height requirements, the asymmetric ERA box 10 provides improved performance over conventional symmetric ERA to disrupt and break-up jet 16 to reduce its ability to penetrate the tank's residual armor. This is accomplished by asymmetrically redistributing mass from the outer plate to the rear plate, which is formed from a high-density material. Common kinetic energy projectiles make use of a long rod penetrator travelling at 1.4 to 2.0 km/s to punch a hole through the armor. Because the asymmetric ERA box 10 puts the same total mass between a kinetic energy projectile and the armor its performance is the same as that of a symmetric ERA box. The asymmetric ERA box 10 must also be configured to avoid detonation due to impact of low-speed projectiles 18 e.g., bullets such as a 50-caliber bullet at less than 1,000 m/s, that would not penetrate the tank's residual armor. Because mass has been redistributed from the outer plate to the rear plate to better disrupt the shape charge jet 16, the outer plate cannot be configured to deflect the low-speed projectiles as is done in symmetric ERA. Instead, the outer plate is formed from a low-density material that serves to attenuate the shockwave of any such projectiles allowing them to pass through the outer layer and embed without detonation the explosive layer.

Figure 2A:
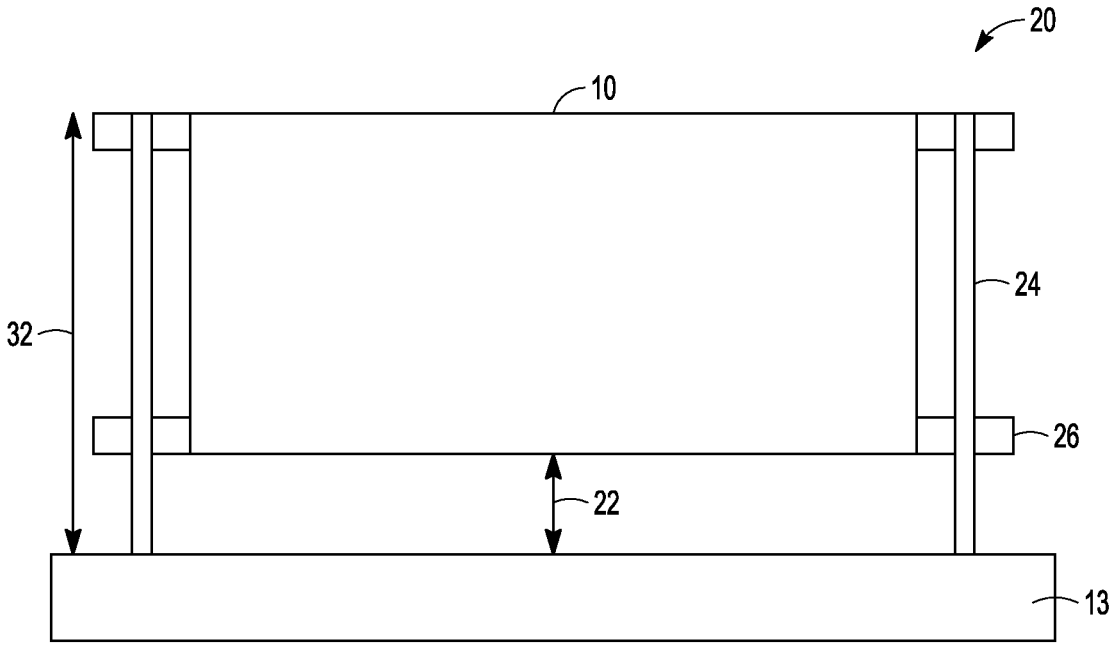
FIGS. 2A and 2B illustrate different techniques to mount the ERA box at a stand-off distance from the residual armor.
Figure 2B:
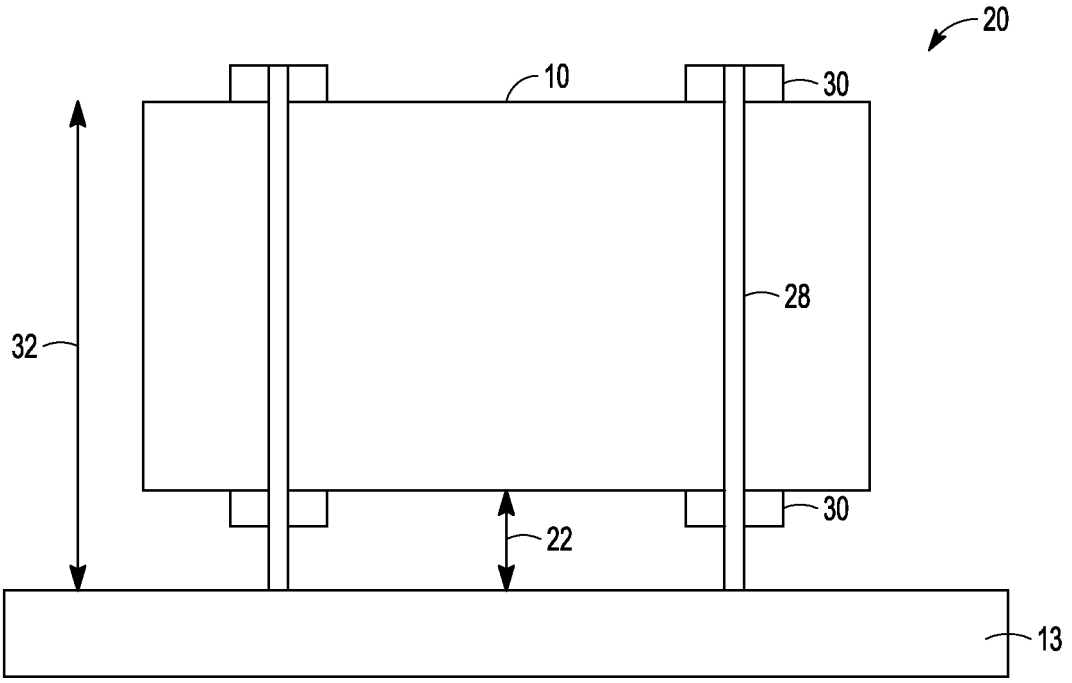

Referring now to FIGS. 2A-2B, the asymmetric ERA box 10 is provided with a mounting bracket 20 that holds the box, and rear plate, at a specified stand-off distance 22 from the residual armor 13. As shown in FIG. 2A, mounting bracket 20 includes four threaded mounting rods 24 that engage mounting ears 26 at the four corners of ERA box 10 and are threaded into the residual armor 13 to the specified stand-off distance (e.g., air-gap) 22. As shown in FIG. 2B, mounting bracket 20 includes four threaded mounting rods 28 that engage prefabricated holes in the various ERA plates at the four corners of ERA box 10 and nuts 30 above and below the box, and are threaded into the residual armor 13 to the specified stand-off distance 22. A total ERA stand-off distance 32 is the air-gap 22 plus the thickness of the ERA box 10.

Areal density is calculated as the mass per unit area or in other words, it is the thickness of a material multiplied by the density of that material. Regarding shape charge jet penetration, both parameters, the target thickness and density, are critical for jet performance. By redistributing the areal density to the rear plate, which travels in the direction of shaped charge jet travel and is closer to the jet tip, an asymmetric ERA can break up the jet closer to the jet tip and reduce the penetration capability. With an identical areal density, symmetric and asymmetrical ERA configurations have similar performance against kinetic energy penetrators. Given the low density and thickness for the areal density of the impedance outer plate, the asymmetric ERA design mitigates detonation from low velocity projectiles such as bullets using shock attenuation, while symmetrical ERA designs deflect these projectiles.

Figure 3A:
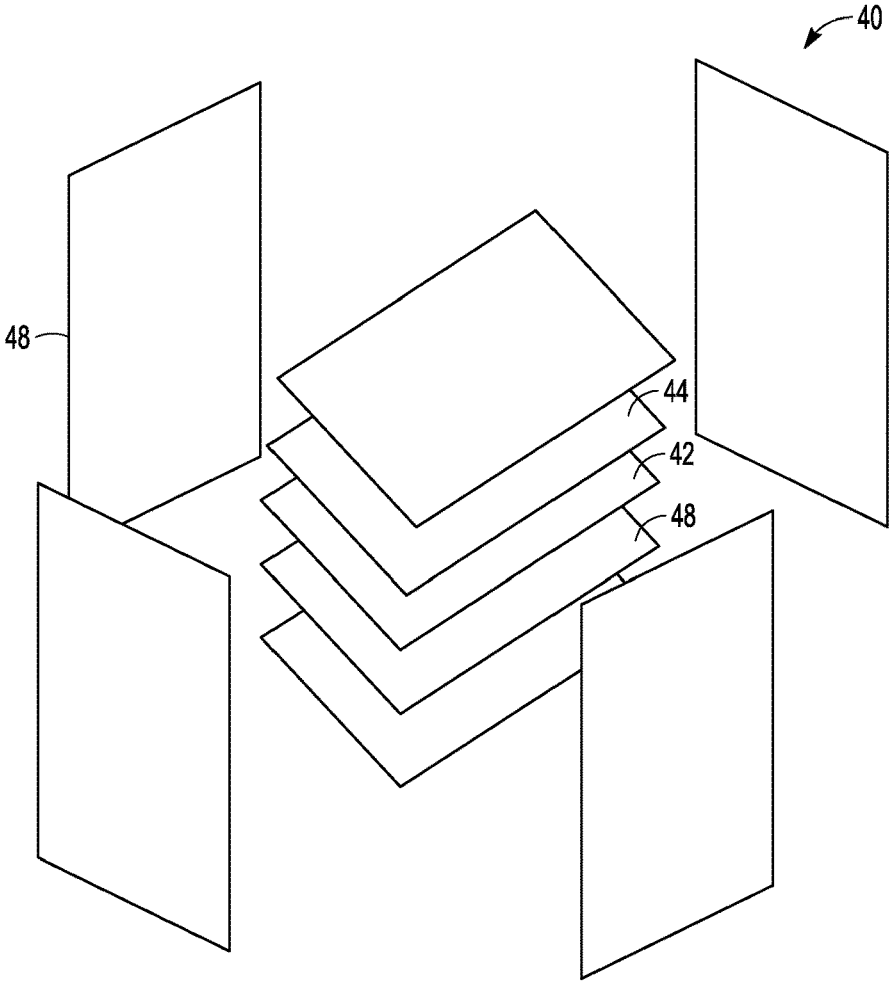
FIGS. 3A-3B are exploded and side views of an embodiment of Asymmetric ERA.
Figure 3B:
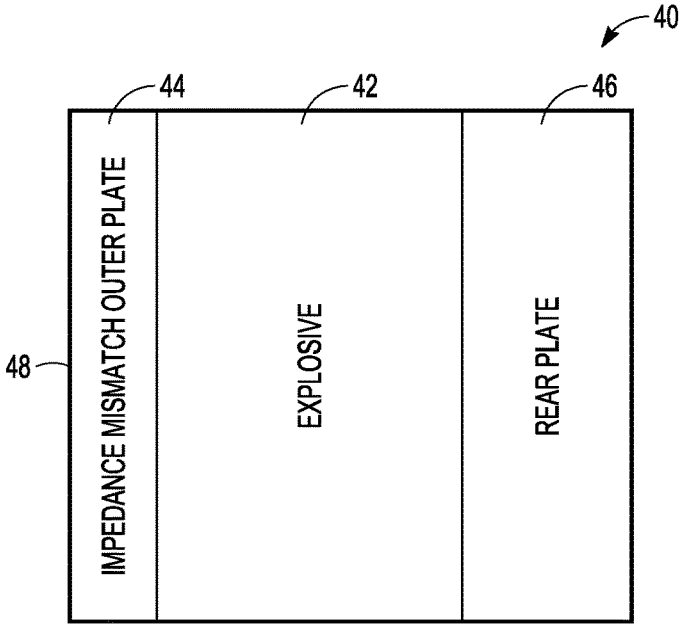
Figure 4:
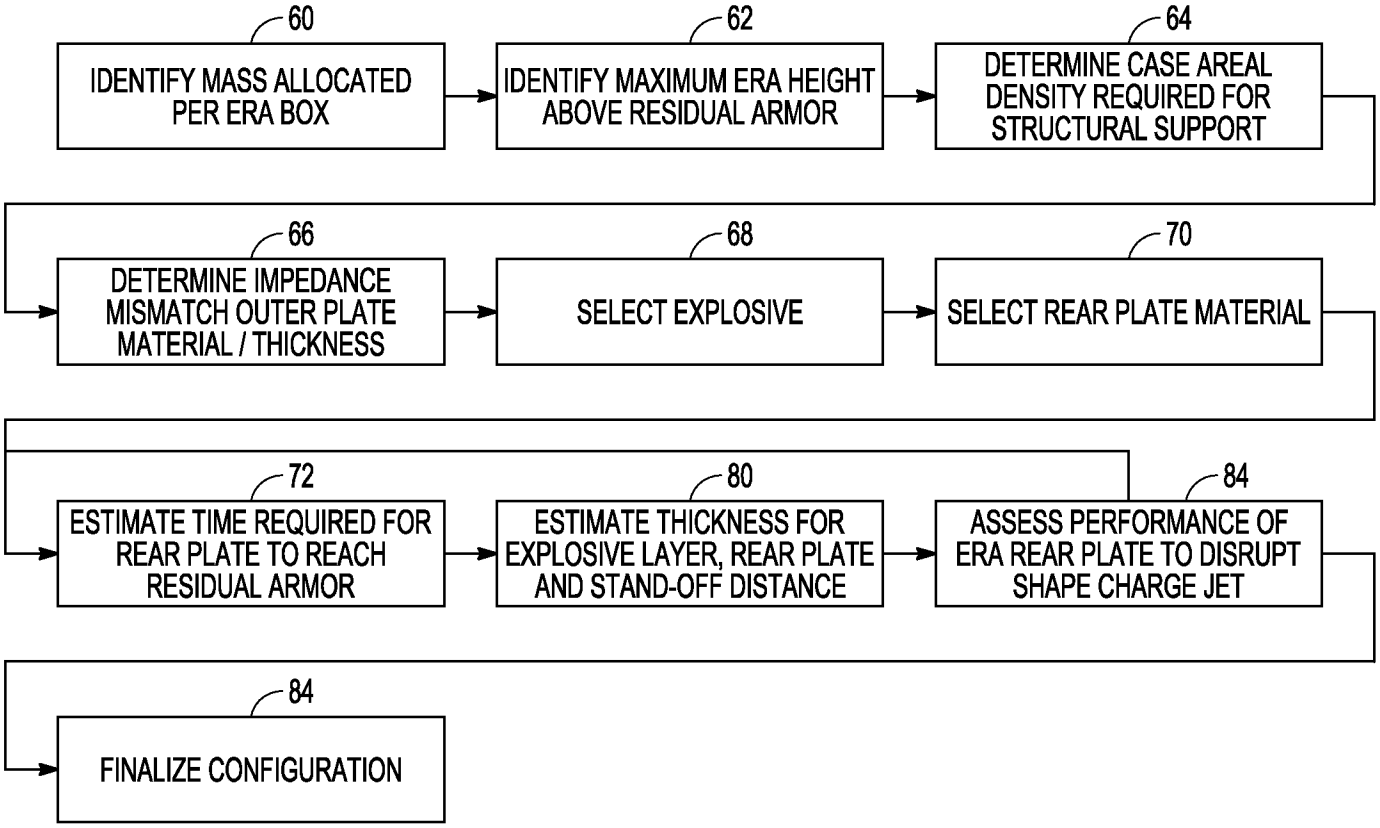
FIG. 4 is a flow diagram of an embodiment for designing Asymmetric ERA for a particular vehicle having weight and shape-charge jet penetration requirements.

Referring now to FIGS. 3A-3B, an embodiment of an asymmetric ERA box 40 comprises an explosive layer 42 sandwiched between an impedance mismatch outer plate 44 and a rear plate 46 all in a casing 48. The impedance mismatch outer plate is formed of material having a density $\rho_o$ of less than 2 g/cm$^3$ and the rear plate is formed from a material having a density $\rho_r$ of at least 4.5 g/cm$^3$. The impedance mismatch outer plate and rear plate provide less than 10% and greater than 60%, respectively, of the areal density of the asymmetric ERA.

The material for outer plate 44 has an impedance mismatch Z that is intentionally designed to reduce a shockwave as it propagates through the outer plate. Z is given by (density $\rho_o$*shock velocity U) where U=bulk sound speed Co+(particle velocity u*slope s) where particle velocity u is the impact velocity of a projectile. $\rho_o$ is less than 2 g/cm$^3$ and preferably less than 1 gm/cm$^3$ and is s is a constant for a given material. Co is less than 3 km/s and more preferably <2.5 km/s. Materials such as high-density polyethylene (HDPE) ($\rho_o$=0.9-0.97 g/cm$^3$, Co=2.3-2.5 km/s), rubber ($\rho_o$=1.1-1.2 g/cm$^3$, Co=2.5-2.8 km/s), silicone ($\rho_o$=1.3-1.5 g/cm$^3$, Co=2.5-2.8 km/s) or lucite ($\rho_o$=1.1-1.3 g/cm$^3$, Co=2.1-2.4 km/s) provide impedance Z values that serve to slow, and thus attenuate the shock waves for low-velocity projectiles. The output plate should be thick enough to defeat a worst-case low velocity projectile. But additional thickness wastes both total available height and mass. The outer plate is typically between 0.5 and 2 cm thick. As a result, initial shockwaves that exceed the detonation threshold of the explosive e.g., 10K to 100K bar, are rapidly attenuated to avoid detonation. High-velocity shape charge jets pass through the outer plate and detonate the explosive layer.

The material for rear plate 46 exhibits both high-density, $\rho_r$ of at least 4.5 g/cm$^3$ and preferably greater than 7 g/cm$^3$, and high yield strength $\sigma_r$ greater than 500 Mega Pascals (MPa) and preferably greater than 1,000 MPAs that is efficient at breaking up the shape charge jet. The rear plate 46 is typically thicker than the outer plate 44, and most importantly is significantly thicker than the rear plate in a conventional symmetric ERA thereby placing more high-density material toward the front of the shape charge jet. Materials such as steel ($\rho_4$=7.7-8.2 g/cm$^3$, $\sigma_r$=500+ MPa), iron ($\rho_4$=7.7-8 g/cm$^3$, $\sigma_r$=500+ MPa), tungsten ($\rho_4$=18-20 g/cm$^3$, $\sigma_r$=500+ MPa) and titanium ($\rho_4$=4.5-4.6 g/cm$^3$, $\sigma_r$=500+ MPa) are high density, high yield strength materials.

At shape charge jet velocities, the impact pressure at the interface of the jet and target act as ideal liquids (do not exhibit any viscosity). Bernoulli's theory says that material density is the only factor, and thus high-density materials reduce penetration more than low density materials.

The penetration capability of a shaped charge jet can be described by $L_P=L_j$*SquareRoot($\rho_j/\rho_T$) where $L_P$ is the depth of target penetration, $L_j$ is the length of the shape charge jet, $\rho_j$ is the density of the jet and $\rho_T$ is the density of the target. The only way to reduce a shape charge jet's penetration capability is to break up the jet. Since the rear plate 46 is positioned closer to the tip of the jet when the ERA reacts, by redistributing mass to the rear plate 46 the jet must cut through more mass causing the jet to break up more quickly thereby reducing its penetration capability. In short, the additional mass in rear plate 46 serves to reduce $L_j$ by exposing the jet to continuously new material which breaks up the jet, which in turn reduces $L_P$.

As shown in FIGS. 2A-B, the stand-off distance 22 of the asymmetric ERA box from the residual armor is typically 30-50% of the total ERA height 32 above the residual armor. The stand-off distance 22 is also between 135 and 285% of the thickness of the rear plate.

A ratio of the areal density of the rear plate 36 to the area density of the outer plate 44 is at least 6:1. This represents a significant redistribution of mass from the outer plate to the rear plate. In a symmetric ERA box this ratio would be 1:1. An areal density budget for an asymmetric ERA box is a front wall of the casing 2.5-5%; the impedance mismatch outer layer 5-10%; the explosive layer 10-25%; the rear plate 60-75%; and the back wall of the casing 2.5-5%. By comparison, if the two plates consume 80% of the areal density budget, in a symmetric ERA box the outer and rear plates would each be 40%.

Figure 5:
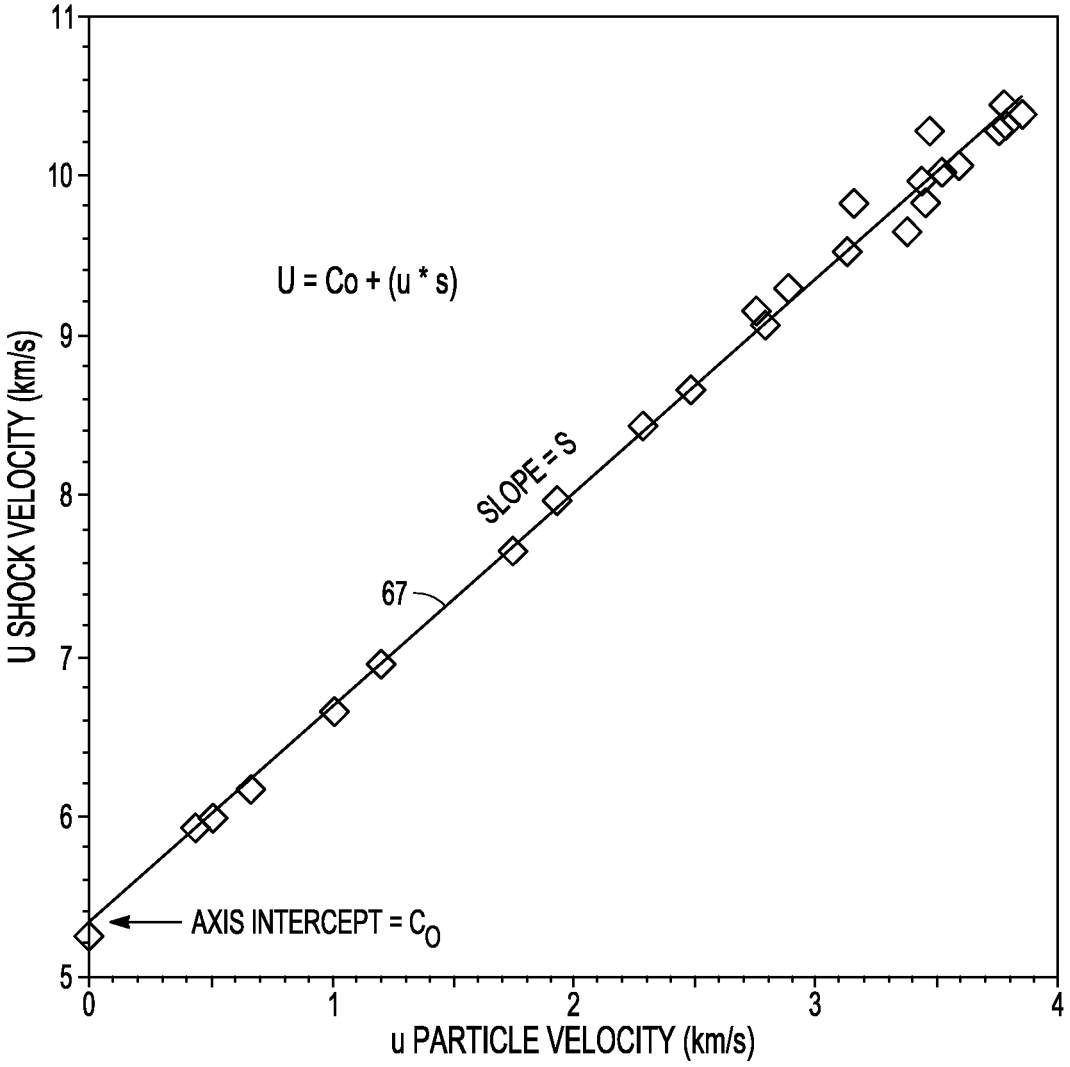
FIG. 5 is a plot of shock velocity U vs particle (impact) velocity u for a low-density material for the impedance mismatch outer plate.
Figure 6A:
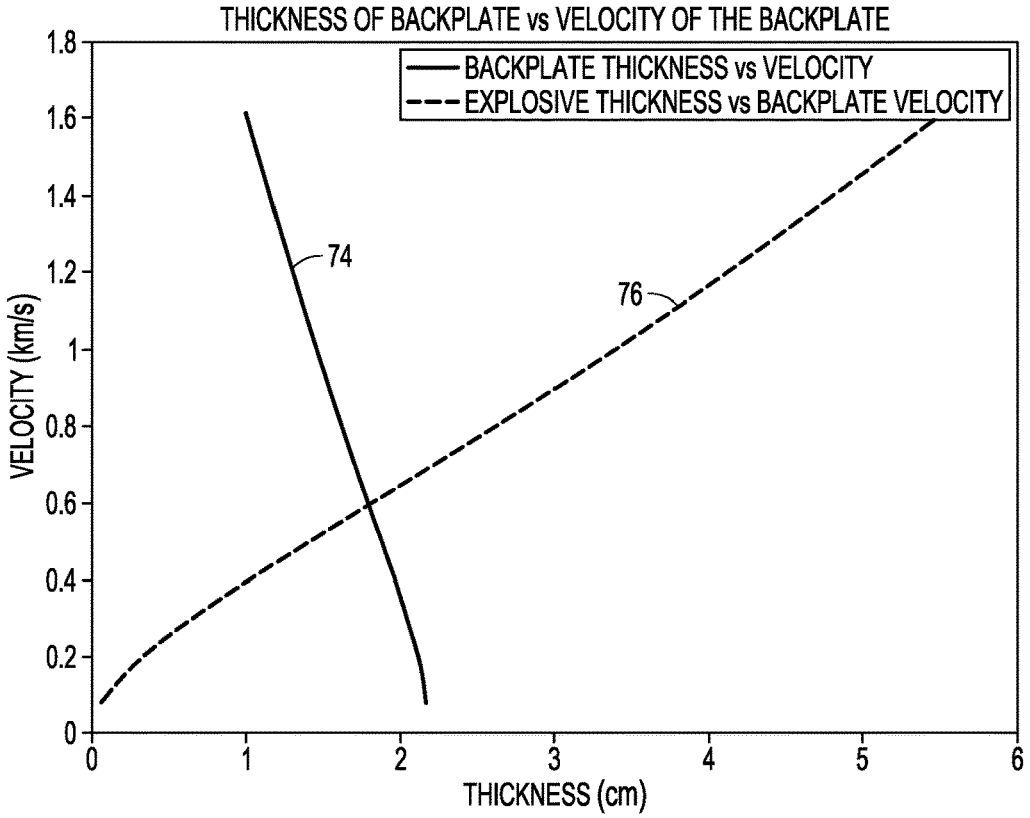
FIGS. 6A-6B are velocity vs rear plate and explosive layer thickness and time to residual armor vs rear plate thickness plots for Asymmetric ERA.
Figure 6B:
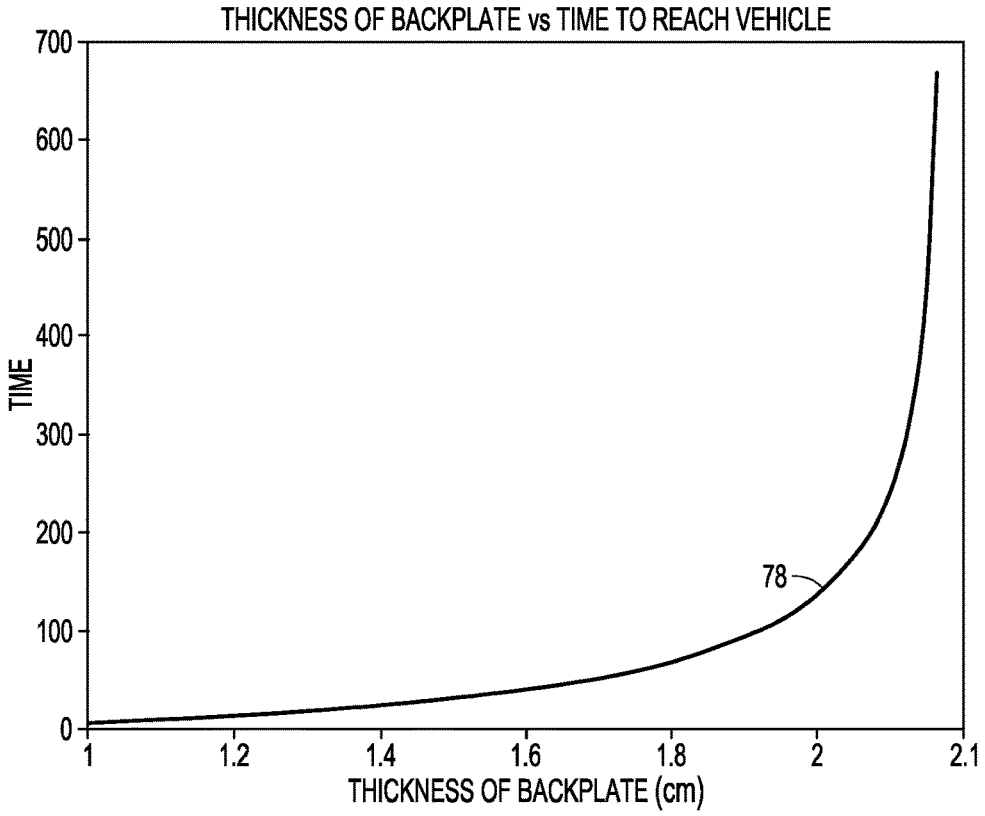
Figure 7A:
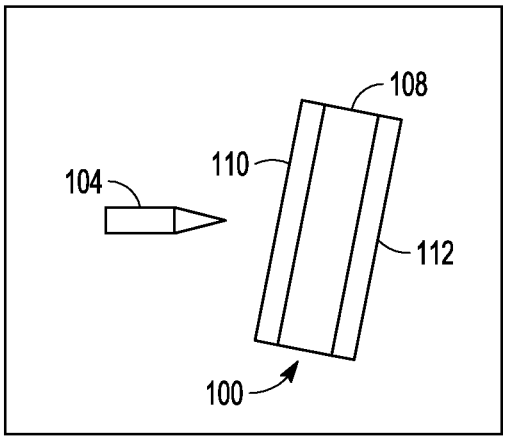
FIGS. 7A-7B and 8A-8B illustrate the response of standard symmetric ERA and the Asymmetric ERA to a low-velocity projectile.
Figure 7B:
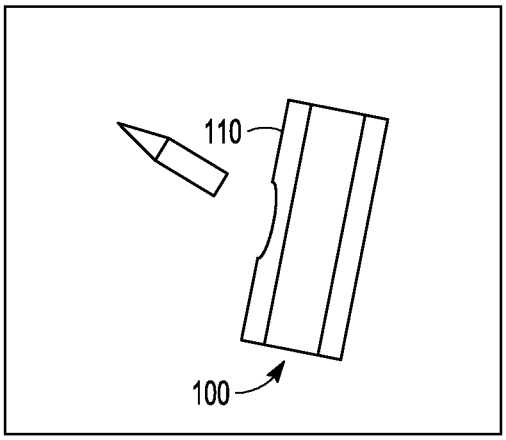
Figure 8A:
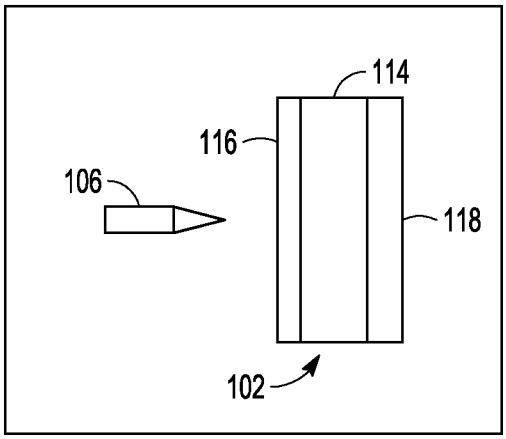
Figure 8B:
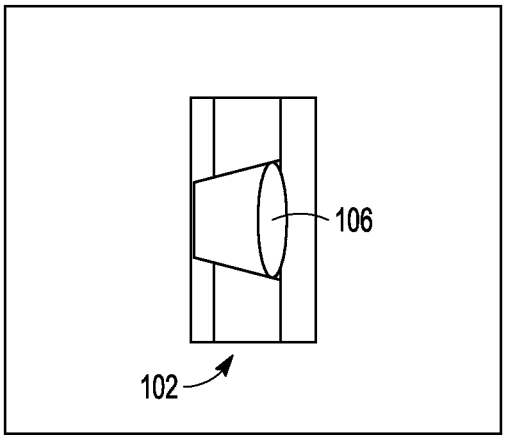

Referring now to FIGS. 4, 5 and 6A-6B, an embodiment for designing an asymmetric ERA box starts by specifying system level requirements of mass allocated per ERA box (step 60), identifying the maximum stand-off height of the ERA (step 62) and determining the areal density of the casing required for structural support (step 64). The allocated mass determines the maximum areal density to be budgeted across the ERA box. In step 66, the impedance mismatch outer plate is designed by determining the low-density material and thickness of the outer plate. This is a function of the "worst case" low-velocity threat and thus independent of the ERA box system level constraints and rest of the design. To avoid wasting available height and mass, the thickness of the outer plate should be only thick enough to attenuate the shockwave of the low-velocity projectile to avoid detonating the explosive. A plot 67 of U=Co+(u*s) where u is the impact velocity of the projectile is shown in FIG. 5. Z=U*$\rho_o$. Selection of a low-density $\rho_o$ and low bulk sound speed Co material provides a low Z outer layer to attenuate the shockwave.

In step 68, the explosive is selected using the Gurney equation for an unsymmetrical sandwich configuration. The Gurney constant describes how energetic and explosive is when detonated. See Gurney, Ronald W. "The Initial Velocities of Fragments from Bombs, Shells and Grenades," Ballistic Research Laboratory, Aberdeen, Maryland, BRL-405, 1943. Selection of the explosive may depend on the Gurney constant, detonation threshold, ability to shape the explosive and the cost of the explosive. Composition A3 explosive is suitable for ERA. In step 70, the high-density, high yield strength material for the rear plate is selected.

To determine the thicknesses of the explosive layer and rear plate and the air gap stand-off distance that provide maximum disruption of the shape charge jet, a nominal time required for the rear plate to reach the residual armor upon detonation is estimated step 72. Given the allocated mass for the asymmetric ERA box, there is a single solution for the explosive layer thickness, rear plate thickness and stand-off distance that provide the rear plate travel time. Using the velocity vs rear plate and explosive layer thickness plots 74 and 76 and time to residual armor vs rear plate thickness plot 78 generated using the Gurney constant and Gurney equation for an unsymmetric sandwich for a particular stand-off distance shown in FIGS. 6A and 6B, the thicknesses of the explosive layer and rear plate and the stand-off distance are estimated in step 80. The performance of the rear plate to disrupt the shape charge jet is assessed in step 82 by, for example, simulating the response of the asymmetric ERA box to a shape charge jet with the specified stand-off distance. The goal is for the rear plate to travel fast enough in the direction of jet travel to disrupt the jet quickly but not so fast that the rear plate hits the residual armor and stops move premature, hence stops disrupting the jet. If the rear plate is too fast, the estimated time in step 72 is increased and the explosive/rear plate mass ratio is reduced in step 80. Conversely, if the rear plate is too slow, the estimated time in step 72 is reduced and the explosive/rear plate mass ratio is increased in step 80. Steps 72, 80 and 82 are repeated until satisfactory, and preferably optimal, disruption of the shape charge jet is achieved and the final configuration of the asymmetric ERA box is set in step 84.

In an example, the mass allocated per ERA box sets the maximum areal density at 20.6 g/cm$^2$ and the maximum total stand-off distance is 8.8 cm above the residual armor. A 0.1 cm thick steel casing was selected for structural support. The impedance mismatch outer plate was formed of Silicone having a density of 1.37 gm/cm$^3$ with a thickness of 1 cm. A Composition A3 explosive layer has a Gurney constant of 2.71 mm/microsecond, density of 1.67 g/cm$^2$ and thickness of 2.28 cm. The rear plate was formed of steel having a density of 8.1 g/cm$^3$ and thickness of 1.69 cm. The areal densities of the outer and rear plates were 1.37=1 cm*1.37 g/cm$^3$ and 13.8=1.69*8.1 g/cm$^3$. The outer plate represents 6.6% and the rear plate 67% of the maximum areal density. The ratio of rear plate areal density to outer plate areal density is 67/6.6=10. These values are further shown in Table 1.

TABLE 1

| Material | rho (g/cm^3) | Areal rho (g/cm^2) | % Areal Rho | Thickness (cm) |
|---|---|---|---|---|
| Case | 7.87 | 0.787 | 3.8% | 0.1 |
| Z Mismatch | 1.37 | 1.37 | 6.6% | 1 |
| Explosive | 1.67 | 3.841 | 18.6% | 2.3 |
| Backplate | 8.13 | 13.821 | 67.1% | 1.7 |
| Case | 7.87 | 0.787 | 3.8% | 0.1 |

FIGS. 7A-7B and 8A-8B illustrate how conventional symmetric ERA 100 and asymmetric ERA 102 defeat low-velocity projectiles 104 and 106 such as a 50-caliber bullet. Symmetric ERA 102 sandwiches an explosive layer 108 between outer and rear plates 110 and 112 formed from the same high-density material such as steel and having the same thickness, hence same areal density. Low-velocity projectile 104 strikes outer plate 110 deforming the outer plate and deflecting away. Consequently, explosive layer 108 is not detonated by the impact of low velocity projectile 104.

Asymmetric ERA 102 sandwiches an explosive layer 114 between an outer plate 116 formed of a low-density material such as HDPE and a rear plate 118 formed of a high-density material such as steel. In general, the rear plate 118 will be thicker than outer plate 116. Equal thickness would be mere coincidence. The areal density of rear plate 118 being at least 6× that of outer plate 116. Low-velocity projectile 116 pass through the low-density outer plate 116 into explosive layer 114. However, the impedance mismatch properties of outer plate 116 owing to the low-density and low bulk sound shock properties of the material attenuate the shockwave such that projectile 106 embeds in explosive layer 114 without detonating the explosive. For most low-velocity projectiles the initial shockwave upon impact with outer plate 116 would exceed the detonation threshold of the explosive. However, the impedance mismatch is sufficient to attenuate the shockwave and avoid detonation. The advantage being that low velocity projectiles are defeated with significantly less mass than is required by the symmetric ERA. This mass can and is moved to the rear plate 118 to degrade any shape charge jets.

Figure 9B:
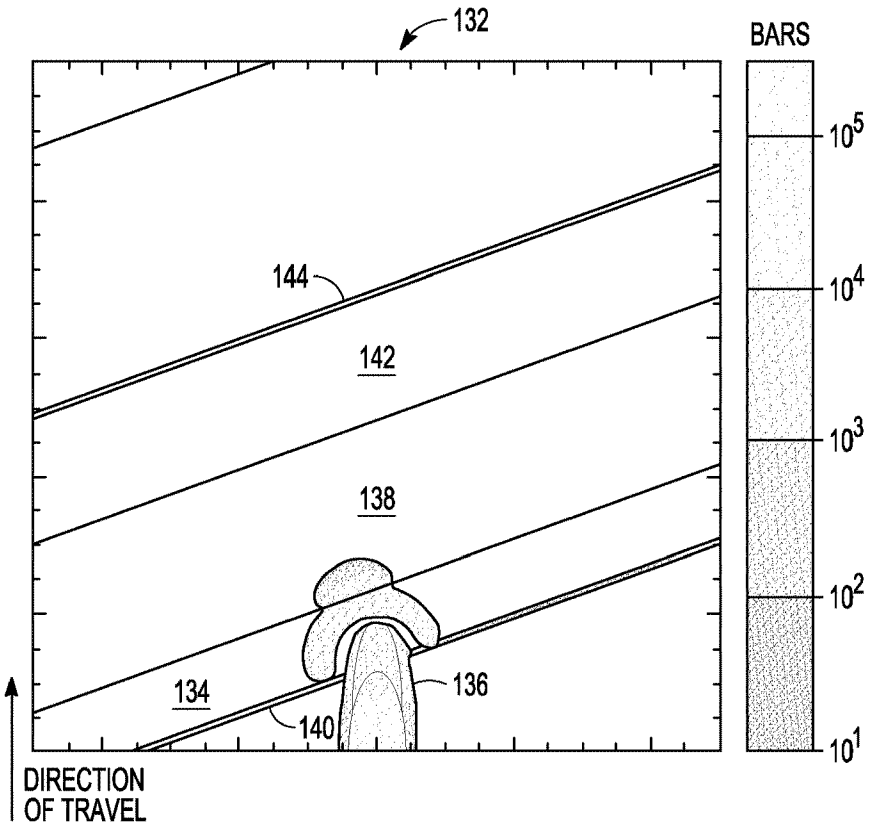
FIGS. 9A-9C illustrate a shockwave traveling through an impedance mismatch outer plate and into the explosive.
Figure 9A:
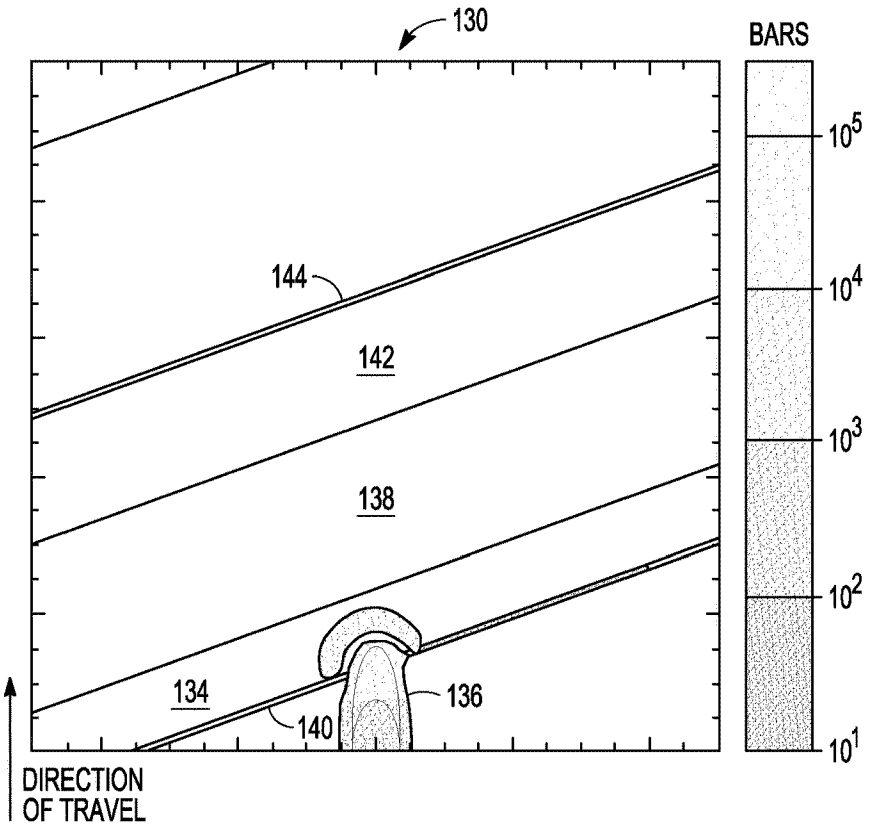
Figure 9C:
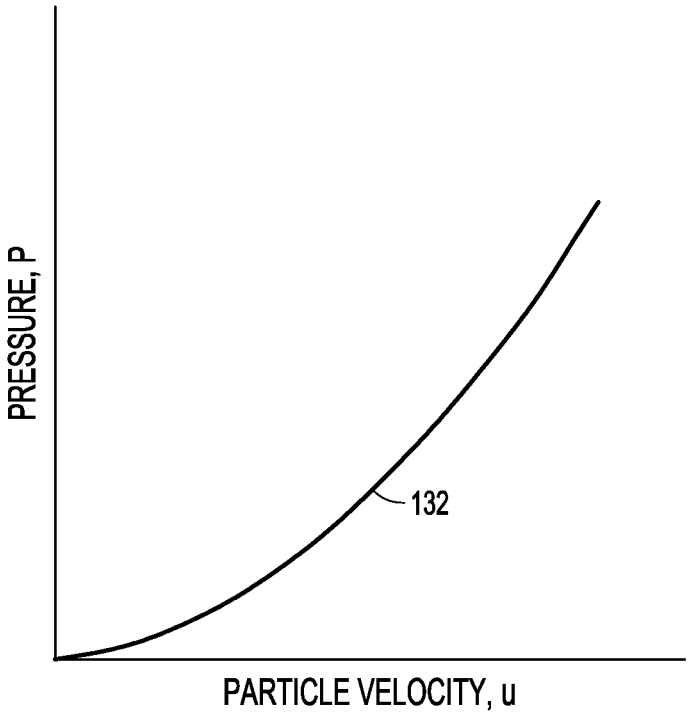
Figure 10A:
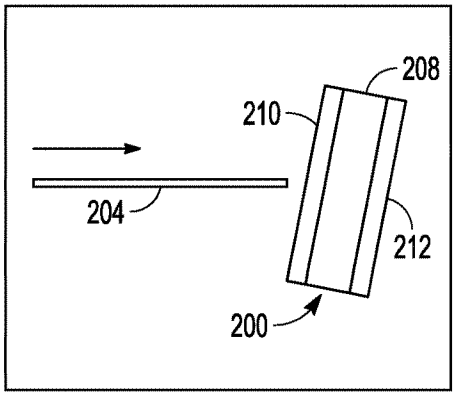
FIGS. 10A-10D and 11A-11D illustrate the response of standard symmetric ERA and the Asymmetric ERA to a high-explosive projectile that fire a shape-charge jet into the ERA.
Figure 10B:
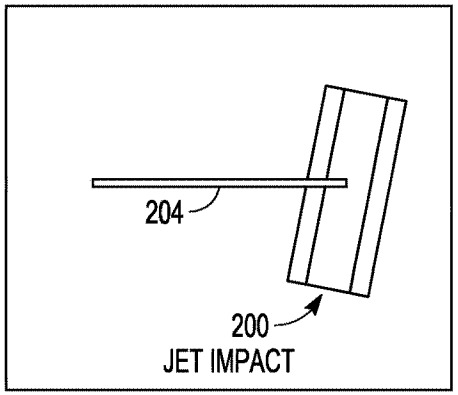
Figure 10C:
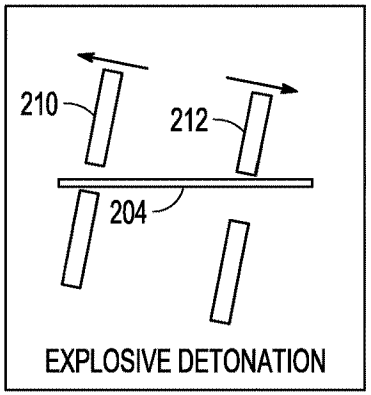
Figure 10D:
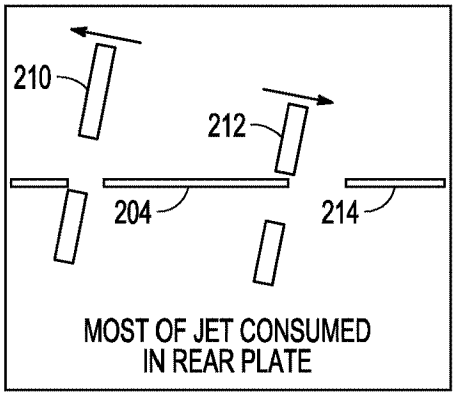
Figure 11A:
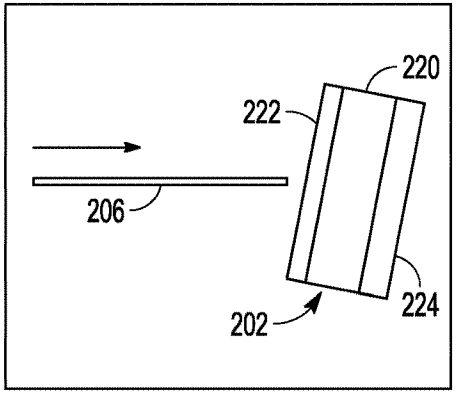
Figure 11B:
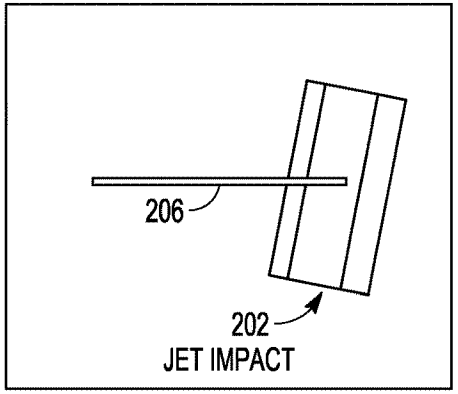
Figure 11C:
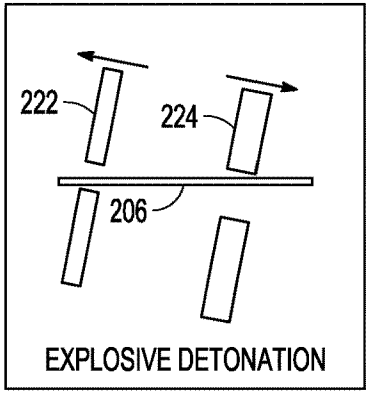
Figure 11D:
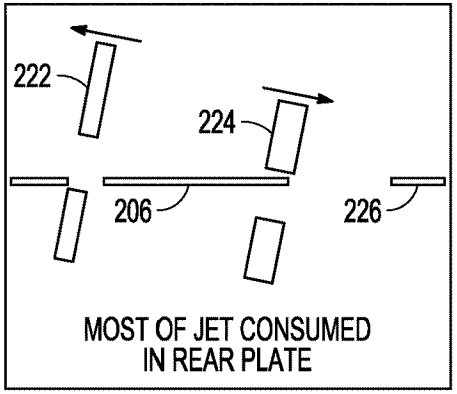

Referring now to FIGS. 9A-9B and 9C, U-u and P-u Hugoniot curves 130 and 132 demonstrate how the impedance mismatch outer plate 134 attenuates a shockwave 136 as the shockwave moves through outer plate 134 into explosive layer 138. As shown, asymmetric ERA includes a front wall 140 of a casing, outer plate 134, explosive layer 138, rear plate 142 and a back wall 144. FIG. 9A shows shockwave 136 as it penetrates front wall 140 and travels through impedance mismatch outer plate 134 attenuating the shockwave. FIG. 9B shows shockwave 136 moving into the explosive layer 138 at shockwave levels less than the detonation threshold. Typical explosives have a detonation threshold between 10K and 100K bar.

FIGS. 10A-10D and 11A-11D illustrate how conventional symmetric ERA 200 and asymmetric ERA 202 disrupt and limit the penetration of high-velocity shape charge jets 204 and 206 into the residual armor surface. As previously described, the depth of target penetration $L_P$ is determined by the length of the shape charge jet $L_j$. The goal of the ERA is to reduce the length of the shape charge jet $L_j$ that reaches the residual armor surface.

As shown in FIGS. 10A-10D, symmetric ERA 200 sandwiches an explosive layer 208 between outer and rear plates 210 and 212 formed from the same high-density material such as steel and having the same thickness, hence same areal density. Shape charge jet 204 penetrates the thin casing, outer plate 210, explosive layer 208 and rear plate 212 to cause explosive detonation. Explosive detonation drives outer plate 210 forward and rear plate 212 backward toward the residual armor surface. Although some of shape charge jet 204 is consumed by outer plate 210 because of the positioning and relative motion of the plates most of the shape charge jet 204 is consumed by rear plate 212. The result is a shape charge jet 214 having a reduced length $L_j$.

As shown in FIGS. 11A-11D, asymmetric ERA 202 sandwiches an explosive layer 220 between an impedance mismatch outer plate 222 formed from a low-density material such as HDPE and a rear plate 224 formed from a high-density material such as steel. The areal density of rear plate 224 being at least 6× that of outer plate 222. Shape charge jet 206 penetrates the thin casing, outer plate 222, explosive layer 220 and rear plate 224 to cause explosive detonation. Explosive detonation drives outer plate 222 forward and rear plate 224 backward toward the residual armor surface. The low-density outer plate 222 has essentially no effect on shape charge jet 206 as it passes therethrough. The rear plate 224 consumes a portion of shape charge jet 206 leaving a shape charge jet 226 having a reduced length $L_j$. Because rear plate 224 is thicker than its counterpart in the symmetric ERA, it consumes more of the shape charge jet than does both the high density outer and rear plates in the symmetric ERA. It is more efficient to put the high-density in the rear plate to engage the tip of the shape charge jet to disrupt and degrade the shape charge jet. This is illustrated by the length Lj of shape charge jet 206 being shorter than the length Lj of shape charge jet 214.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

I claim:

1. Asymmetric Explosive Reactive Armor (ERA) for protecting residual armor surfaces from projectiles, comprising an explosive layer sandwiched between an impedance mismatch outer plate and a rear plate, wherein the impedance mismatch outer plate is formed of material having a density $\rho_o$ of less than 2 g/cm$^3$ and the rear plate is formed from a material having a density $\rho_r$ of at least 4.5 g/cm$^3$, wherein the impedance mismatch outer plate and rear plate provide less than 10% and greater than 60%, respectively, of the areal density of the asymmetric ERA.

2. The asymmetric ERA of claim 1, wherein density $\rho_o$ is less than 1 g/cm$^3$.

3. The asymmetric ERA of claim 1, wherein the outer plate material has an impedance given by density $\rho_o$*shock velocity U where U=bulk sound speed Co+(particle velocity u*slope s), wherein the bulk sound speed Co is less than 3 km/s.

4. The asymmetric ERA of claim 3, wherein the impedance mismatch outer layer is configured such that a projectile impacting the outer layer at less than 1,000 m/s as particle velocity u produces an initial shockwave sufficient to detonate the explosive layer, said outer layer so configured to slow and attenuate the initial shockwave such that the projectile passes through the outer layer and embeds in without detonating the explosive layer.

5. The asymmetric ERA of claim 4, wherein the impedance mismatch outer layer is configured such that a shape-charge jet travelling in excess of 2,000 m/s passes through the outer plate with minimal disruption of the shape-charge jet, wherein the shape-charge jet detonates the explosive layer driving the rear plate toward the residual armor to disrupt the shape charge jet as it passes through the mass of the rear plate.

6. The asymmetric ERA of claim 1, wherein the outer layer is between 0.5 and 2 cm thick.

7. The asymmetric ERA of claim 1, wherein density $\rho_r$ is at least 7 g/cm$^3$.

8. The asymmetric ERA of claim 1, wherein the rear plate material has a yield strength $\sigma_r$ greater than 500 Mega Pascals.

9. The asymmetric ERA of claim 1, wherein the rear plate is thicker than the impedance mismatch outer plate.

10. The asymmetric ERA of claim 1, wherein the rear plate is configured to be held at a stand-off distance from the residual armor.

11. The asymmetric ERA of claim 10, wherein the stand-off distance is 135 to 285% of the thickness of the rear plate.

12. The asymmetric ERA of claim 1, wherein a ratio of the areal density of the rear plate to the outer plate is at least 6:1.

13. The asymmetric ERA of claim 1, further comprising a casing that encloses the volume of the explosive layer sandwiched between the impedance mismatch outer plate and the rear plate, wherein the areal density of 100% is allocated according to:

a front wall of the casing 2.5-5%;
the impedance mismatch outer layer 5-10%;
the explosive layer 10-25%;
the rear plate 60-75%; and
the back wall of the casing 2.5-5%.

14. Asymmetric Explosive Reactive Armor (ERA) for protecting residual armor surfaces from projectiles, comprising an explosive layer sandwiched between an impedance mismatch outer plate and a rear plate and a mounting bracket to hold the rear plate at a stand-off distance from the residual armor surface, wherein the impedance mismatch outer plate is formed of material having a density $\rho_o$ of less than 2 gm/cm$^3$ and a bulk sound speed Co of less than 3 km/s and the rear plate is formed from a material having a density $\rho_r$ of at least 4.5 gm/cm$^3$ and a yield strength $\sigma_r$ of at least 500 MPa, wherein a ratio of an areal density of the rear plate to the outer plate is at least 6:1, wherein the stand-off distance is between 135% and 285% of the thickness of the rear plate.

15. The asymmetric ERA of claim 14, wherein the outer plate material has an impedance given by density $\rho_o$*shock velocity U where U=bulk sound speed Co+(particle velocity u*slope s).

16. The asymmetric ERA of claim 14, wherein the impedance mismatch outer layer is configured such that a projectile impacting the outer layer at less than 1,000 m/s as particle velocity u produces an initial shockwave sufficient to detonate the explosive layer, said outer layer so configured to slow and attenuate the initial shockwave such that the projectile passes through the outer layer and embeds in without detonating the explosive layer.

17. The asymmetric ERA of claim 16, wherein the impedance mismatch outer layer is configured such that a shape-charge jet travelling in excess of 2,000 m/s passes through the outpour plate with minimal disruption of the shape-charge jet, wherein the shape-charge jet detonates the explosive layer driving the rear plate toward the residual armor to disrupt the shape charge jet as it passes through the mass of the rear plate.

18. Asymmetric Explosive Reactive Armor (ERA) for protecting residual armor surfaces from projectiles, comprising an explosive layer sandwiched between an impedance mismatch outer plate and a rear plate and a mounting bracket to hold the rear plate at a stand-off distance from the residual armor surface, wherein the impedance mismatch outer plate is formed of material having a density $\rho_o$ of less than 2 gm/cm$^3$ and the rear plate is formed from a material having a density $\rho_r$ of at least 4.5 gm/cm$^3$, wherein the impedance mismatch outer plate attenuates a shockwave of incident projectiles traveling at less than 1,000 m/s that pass through the impedance mismatch outer plate and embed in without detonating the explosive layer, wherein shape charge jets traveling in excess of 2,000 m/s pass through the impedance mismatch outer plate with minimal disruption of the shape charge jet detonating the explosive layer driving the rear plate toward the residual armor to disrupt the shape charge jet as it passes through the mass of the rear plate.

19. The asymmetric ERA of claim 18, wherein the outer plate material has an impedance given by density $\rho_o$*shock velocity U where U=bulk sound speed Co+(particle velocity u*slope s), wherein the sound speed Co is less than 3 km/s.

20. The asymmetric ERA of claim 18, wherein a ratio of an areal density of the rear plate to the outer plate is at least 6:1.

* * * * *